US010274194B2

(12) United States Patent
Chudnovsky et al.

(10) Patent No.: US 10,274,194 B2
(45) Date of Patent: Apr. 30, 2019

(54) METHODS AND SYSTEMS FOR REDUCING EMISSIONS OF NITROGEN OXIDES FROM RIBBON BURNERS

(71) Applicants: Yaroslav Chudnovsky, Skokie, IL (US); Serguei Zelepouga, Charlotte, NC (US); John Wagner, La Grange, IL (US)

(72) Inventors: Yaroslav Chudnovsky, Skokie, IL (US); Serguei Zelepouga, Charlotte, NC (US); John Wagner, La Grange, IL (US)

(73) Assignee: Utilization Technology Development, NFP, Des Plaines, IL (US)

( * ) Notice: Subject to any disclaimer, the term of this patent is extended or adjusted under 35 U.S.C. 154(b) by 290 days.

(21) Appl. No.: 14/576,565

(22) Filed: Dec. 19, 2014

(65) Prior Publication Data

US 2016/0178194 A1 Jun. 23, 2016

(51) Int. Cl.

| | |
|---|---|
| ***C10L 1/12*** | (2006.01) |
| ***F23C 9/08*** | (2006.01) |
| ***F23D 14/02*** | (2006.01) |

(52) U.S. Cl.

CPC ..... *F23C 9/08* (2013.01); *F23D 14/02* (2013.01); *F23C 2202/30* (2013.01); *F23C 2202/50* (2013.01)

(58) Field of Classification Search

CPC .... F23C 9/08; F23C 9/00; F23C 9/006; F23C 2202/30

USPC ..... 431/115, 116, 350; 126/79

See application file for complete search history.

(56) References Cited

U.S. PATENT DOCUMENTS

| | | | | |
|---|---|---|---|---|
| 2,210,069 | A | 8/1940 | Ensign | |
| 2,378,839 | A | 6/1945 | Ensign et al. | |
| 3,351,048 | A * | 11/1967 | Fannon, Jr. | F23C 99/00 126/92 B |
| 3,529,578 | A * | 9/1970 | Gething | F23D 14/586 122/45 |
| 4,083,353 | A | 4/1978 | Petry | |
| 5,411,394 | A * | 5/1995 | Beer | F23C 7/006 110/262 |
| 6,007,326 | A * | 12/1999 | Ryan, III | F23C 7/02 110/261 |
| 2002/0197574 | A1 * | 12/2002 | Jones | F23C 6/047 431/8 |

OTHER PUBLICATIONS https://www.flynnburner.com, Flynn Burner Corporation, © 2014, Ribbon burner OEM (4 pages).

https://www.selas.com, Selas Heat Technology Company, © 2014, Ribbon burner OEM (1 page).

* cited by examiner

*Primary Examiner* — Vivek K Shirsat

(74) *Attorney, Agent, or Firm* — Pauley Erickson & Kottis

(57) ABSTRACT

Methods and systems for improving burner, particularly ribbon burner performance, involving admixing a portion of the combustion products from the flue gas resulting from the burner to at least one of a primary and a secondary oxidizer supply to the burner. Admixing a portion of a carbon dioxide-containing flue gas combustion product formed upon combustion of a fuel gas by a ribbon burner significantly reduces NOx emissions resulting from operation of the burner.

19 Claims, 4 Drawing Sheets

METHODS AND SYSTEMS FOR REDUCING EMISSIONS OF NITROGEN OXIDES FROM RIBBON BURNERS

FIELD OF THE INVENTION

This invention relates generally to improving emissions resulting from operation of burners and, more specifically, to reducing emissions of nitrogen oxides from burners particularly, ribbon burners.

BACKGROUND OF THE INVENTION

The ribbon burner is a mature low cost technology which is well liked and accepted by multiple industries. For example, ribbon burners have found widespread application in many industrial baking, drying and surface treatment applications.

Ribbon burners conventionally utilize a long, thin slot filled with corrugated metal strips to create a narrow array of short interconnected flames.

Burners are typically operated either fully aerated (fully premixed oxidizer and fuel) or partially aerated (partially premixed oxidizer and fuel). In practice, the typical or common oxidizer media used with conventional burners is air. In such operation, the portion of air used for (partial) combustion that is mixed with the fuel is commonly called "primary air"; the remaining portion of air is commonly called "secondary air". Fully aerated burners use only primary air; partially aerated burners use both primary air and secondary air.

In combustion processing, the degree of partial aeration is often expressed via what is commonly referred to as the "Primary Equivalence Ratio" or PER. The PER is the primary fuel/(oxidizer or air) ratio divided by the stoichiometric fuel/(oxidizer or air) ratio. The stoichiometric fuel/(oxidizer or air) ratio is the theoretical ratio of fuel to (oxidizer or air) that results in complete combustion with no remaining or left over fuel and no left over (oxidizer or air).

Ribbon burners that are fueled with natural gas and the emissions that are formed or produced thereby have been or are in the process of coming under stricter and stricter regulations in various selected regions of the United States, e.g., California. Consequently, reducing emissions of nitrogen oxides (commonly represented as "NOx" and typically including one or more of NO, $NO_2$, and $N_2O$) is critical to the continued use of ribbon burners.

The development of a lower NOx emission ribbon burner without jeopardizing the simplicity, reliability, and the low cost advantages normally associated with the use of ribbon burners has presented a significant challenge. One attempted approach for reducing NOx in ribbon burners as well as in other partially premixed types of burners has been through the burner utilization of porous or mesh materials rather than corrugated metal strips. Such an approach allows increasing the heat transfer from the combustion process via the radiation mode of operation while also reducing the flame temperature. As a result, such an approach may act to reduce thermal NOx formation. This approach, however, has its shortcomings including power output limitations as well as reduced or lower reliability and durability.

If the NOx emission performance of ribbon burners is not significantly improved within the near term, users of ribbon burners such as in the baking industry and the drying industry, for example, may be forced to replace established, cost effective and reliable ribbon burner technology with some lower NOx emission alternative such as expensive electric alternatives.

Thus, there is a need and a demand ribbon burners and/or a method for operating ribbon burners such that desired NOx emission performance can be realized.

SUMMARY OF THE INVENTION

A general object of the invention is to provide improved burner performance.

A more specific objective of the invention is to overcome one or more of the problems described above.

One aspect of the invention relates to methods for reducing emissions of nitrogen oxides, from burners, such as ribbon burners, for example.

As described in greater detail below, one subject method for reducing emissions of nitrogen oxides from a burner that upon combustion operation forms a flue gas containing combustion products involves admixing a portion of flue gas combustion products to at least one of a primary and a secondary oxidizer supply to the burner.

In another aspect of the invention, there is provided a method for reducing emissions of nitrogen oxides from a ribbon burner that serves to combust a fuel gas and form a flue gas containing or including combustion products. One such method involves admixing a portion of flue gas combustion products to at least one of a primary and a secondary oxidizer supply to the ribbon burner.

Another aspect of the invention, there is provided a method for reducing emissions of nitrogen oxides from a ribbon burner that combusts a fuel gas of natural gas (or propane, butane, synthesis gas (syngas), landfill gas, etc.) Such a method involves admixing a portion of a carbon dioxide-containing flue gas combustion product formed upon combustion of the fuel gas by the ribbon burner to at least a selected one of a primary and a secondary air oxidizer supply to the ribbon burner to reduce oxygen content in the selected oxidizer supply to less than ambient (e.g., <20.9%).

The invention is described more fully below making specific reference to the use of "air" in or with the burner and the combustion processing occurring therewith. Those skilled in the art and guided by the teaching herein provided will, however, understand and appreciate that as used herein the term "air" generally encompasses burner appropriate oxidizer media such as include oxygen in sufficient relative amounts for the desired combustion processing to occur.

As used herein, references to "primary air", "primary air supply" and the like are to be generally understood as to refer to the portion of air used for combustion that is mixed or premixed with the fuel. Fully aerated burners use only primary air.

As used herein, references to "secondary air" and the like are to be generally understood as to refer to the remaining portion of air used for (partial) combustion that is not mixed with the fuel. Thus, partially aerated burners use both primary air and secondary air.

Other objects and advantages will be apparent to those skilled in the art from the following detailed description taken in conjunction with the appended claims and drawings.

DETAILED DESCRIPTION OF THE INVENTION

As detailed further below, the invention generally provides improved burner performance such as by reducing emissions of nitrogen oxides.

In accordance with one aspect of the invention, significant reductions of NOx emissions from a burner, particularly a ribbon burner, is based at least in part and, in accordance with certain preferred embodiments primarily on modifying the primary and/or secondary oxidizer/air composition by admixing at least a portion of carbon dioxide ($CO_2$) and/or other combustion products from the flue gas produced or formed by or upon operation of the burn into or with the primary and/or secondary oxidizer/air supply to the burner. That is in a subject invented system in accordance with one aspect of the invention, a portion of the flue gases is recirculated by admixing a selected percentage of the flue gas into or with the primary and/or the secondary air streams. As a result the combustion of the gaseous fuel (e.g., natural gas, propane, butane, syngas, etc.) occurs with an oxidizer/air stream or streams containing a reduced or lower concentration of oxygen and at lower flame temperature, thus producing or resulting in reduced or lower emissions of thermal nitrogen oxides.

While the broader practice of the invention is not to be unnecessarily limited to or by a specific or particular theory of underlying operation, it is believed that dilution of an oxidizer stream with the products of combustion, as realized hereby, leads to a reduction of the oxygen concentration in the combustion zone and as a result reduces flame temperature and consequently reduces NOx formation via the thermal mechanism, one of three or four mechanisms typically associated with NOx formation in combustion processes. In the thermal mechanism, the amount of NOx formation increases with temperature and increases with oxygen concentration. The subject approach can enable significantly reduced NOx emissions without unnecessarily sacrificing the simplicity, low cost, reliability, and safety of processes associated with the utilization of selected designs of burners, such as ribbon burners, for example.

Figure 1:
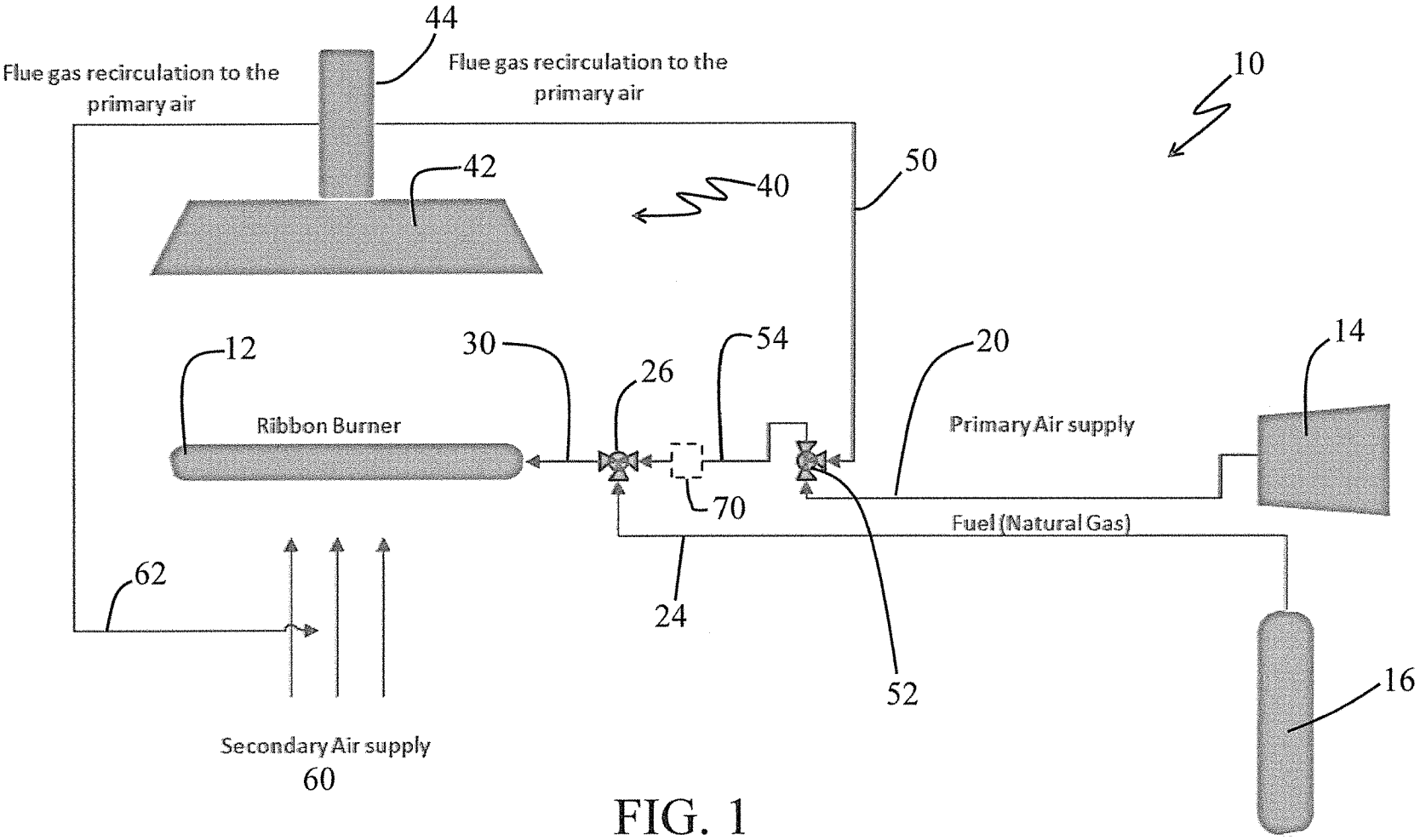
FIG. 1 is a simplified schematic of a system for reducing nitrogen oxide emissions in accordance with one embodiment of the invention.

Turning to FIG. 1, there is shown a simplified schematic of a system, generally designated by the reference numeral 10, for reducing nitrogen oxide emissions from a burner in accordance with one embodiment of the invention. The system 10 includes one of more ribbon burners 12 equipped or provided with an appropriate oxidizer from an oxidizer supply 14 and an appropriate fuel from a fuel supply 16. Oxidizer from the oxidizer supply 14 is fed to the burner 12 via a line 20. Fuel from the fuel supply 16 is fed to the burner 12 by the line 24. As shown, the oxidizer and fuel can be premixed prior to introduction into or to the burner 12 such as via a mixing venturi 26, with the oxidizer-fuel mixture being fed via a line 30 to the burner 12.

In one preferred embodiment, the oxidizer can appropriately be air and the fuel can appropriately be natural gas. Those skilled in the art and guided by the teaching herein provide will, however, understand and appreciate that the broader practice of the invention is not necessarily so limited as for example, other fuel materials, particularly gaseous fuel materials such as propane, and other oxidizer media such as oxygen enriched air and oxygen, for example, can be used.

Typically, a combustion air fan is used to supply primary air to the mixing venturi 26 where it is mixed with the fuel (usually natural gas and sometimes propane).

The system 10 is also provided with a flue gas recovery apparatus 40 such as including or having an exhaust hood 42 and an associated exhaust duct 44 whereby flue gas formed upon operation of the burner 12 can be appropriately handled.

As schematically shown in FIG. 1, a portion of the flue gas is passed via a line 50 to a mixing venturi 52 where such flue gas is appropriately mixed with oxidizer (e.g., air) from the line 20, with the flue gas and oxidizer combination being fed via a line 54 to the mixing venture 26.

It has been discovered that supplying higher fractions of combustion oxidizer as primary oxidizer results in reduced NOx emissions from ribbon burners.

It has been found that depending on specific or particular industrial process requirements, ribbon burners can be operated with a PER as high as 2.0, when only 50% of the needed combustion air is supplied as the primary air, or can be operated with a PER as low as 1.0 (i.e., fully aerated). Consequently, because of such process requirements, maximization of the PER cannot always be used as a NOx minimizing technique in industrial settings.

As shown in FIG. 1, where the burner 12 is a partially aerated burner, secondary air can be provided to the burner 12 from a secondary air supply 60. If desired, and as shown, a portion of the flue gas is passed via a line 62 and added to secondary air fed to the burner 12.

A preferred implementation of the described invention requires the inclusion of an appropriate technique or system for admixing a portion of the flue gases from the ribbon burner into the primary and/or secondary air stream(s). For industrial/commercial baking and drying applications, the flue gases are typically already gathered into or via a common flue duct or ducts, aka flue stack(s). Thus, desired implementation of the invention can be realized through the simple inclusion and connection of a branch line to this or these stack(s). For example, a blower can be used to draw a portion of the flue gases out of the stack through the branch line and push the flue gases into the primary and/or secondary air stream(s). Alternatively, an eductor can be used instead of a blower and compressed air (or a pressurized inert gas) can be used to drive the eductor. Another alternative, such as may be appropriate for use in connection the primary air stream and where the fuel is not used to inspirate the primary air, would be to use an eductor with the fuel as the driving force for the eductor. Yet another possible alternative would be to use one blower for both the primary air and a portion of the flue gas, where a tee is installed upstream of the blower and one or more dampers are used to meter the proper ratio of primary air to flue gas. FIG. 1 shows in outline an optional single blower 70 for both primary air and flue gas combustion products ($CO_2$).

In some applications, such as at least in some direct baking and direct drying operations, water vapor may also be a constituent in the flue gas. The admixing of such water vapor with the oxidizer can and may serve to further reduce NOx emissions such as by cooling or reducing the flame temperature and/or altering process kinetics, for example.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

The concept of the invented system has been proven using laboratory facilities. The flue gas recirculation was simulated with $CO_2$ admixing into the primary air stream using the laboratory experimental arrangement, generally designated by the reference numeral 110, shown in FIG. 2.

Figure 2:
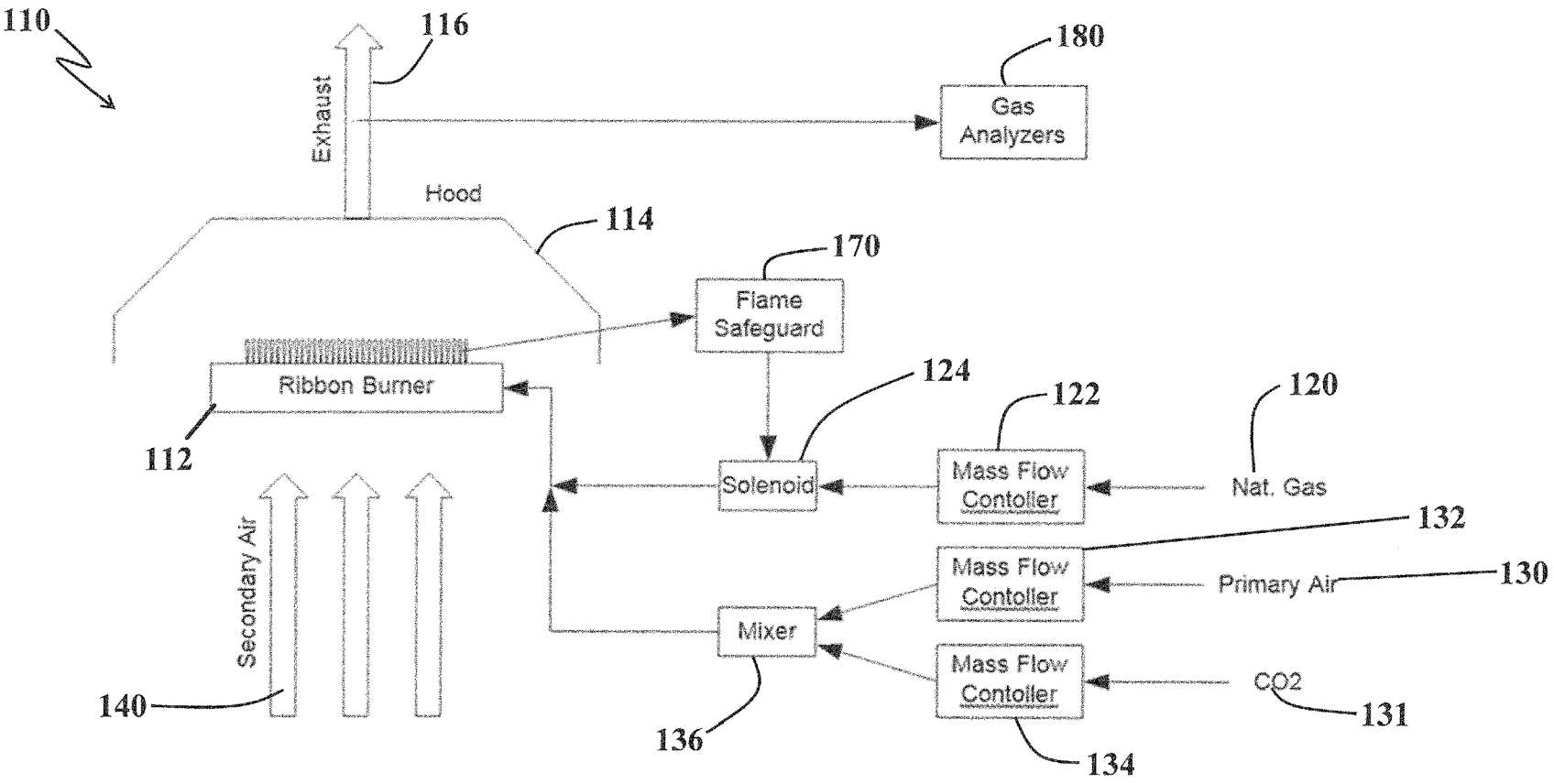
FIG. 2 is a simplified schematic of an experimental set-up used in some examples herein described.

As schematically shown in FIG. 2, the system 110 included a ribbon burner 112 with an exhaust hood 114 and exhaust duct 116 in association with the burner 112. The burner 112 was connected to or with a source of fuel, e.g., natural gas 120, via a flow controller 122 and a solenoid valve 124. The burner 112 was also connected to or with a source of primary air 130 and a source of $CO_2$ 131 via respective mass flow controllers 132 and 134, respectively, and a mixer 136. The fuel and the primary air/$CO_2$ were combined or mixed prior to introduction to the burner 112, as shown. A supply of secondary air, depicted by the arrows 140, was also connected to the burner 112.

The system 110 further included a flame safeguard 170 appropriately interconnected to the fuel supply solenoid 124.

The exhaust from the burner 112 was appropriately interconnected with gas analyzers 180 whereby the exhaust composition was appropriately analyzed and determined.

Figure 3:
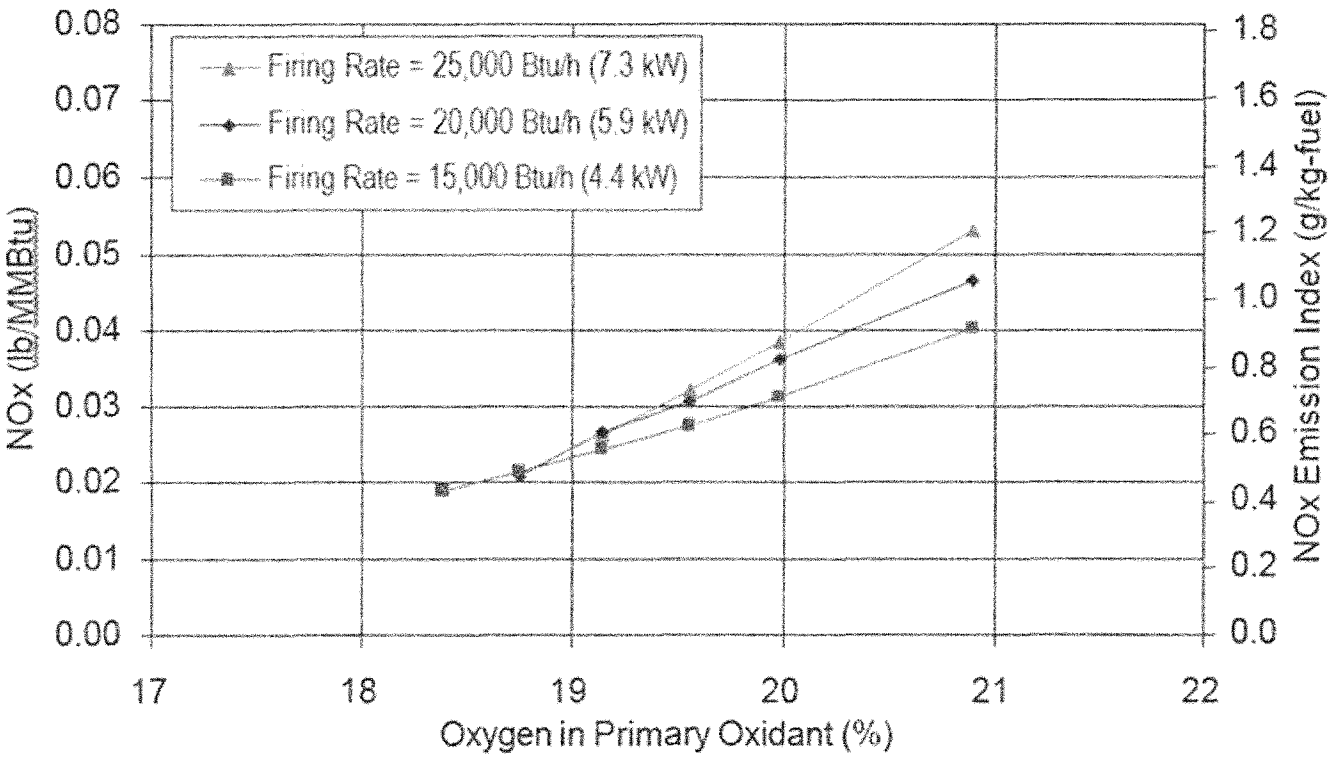
FIG. 3 is a graphical representation of NOx emissions versus oxygen content in the primary oxidant realized at selected burn rates of a ribbon burner in accordance with some examples herein described.

FIG. 3 depicts reductions of the NOx formation in the ribbon burner's flame with dilution of the primary oxidant supplied to the burner with $CO_2$, at the burner firing rates of 15,000 BTU/h; 20,000 BTU/h; and 25,000 BTU/h, respectively. The overall oxygen to the fuel ratio was not changed to maintain the complete combustion, but as a result of the dilution the effective concentration of the oxygen in the primary oxidant stream (the mixture of primary air and $CO_2$) was decreased down to as low as 18.4%.

Figure 4:
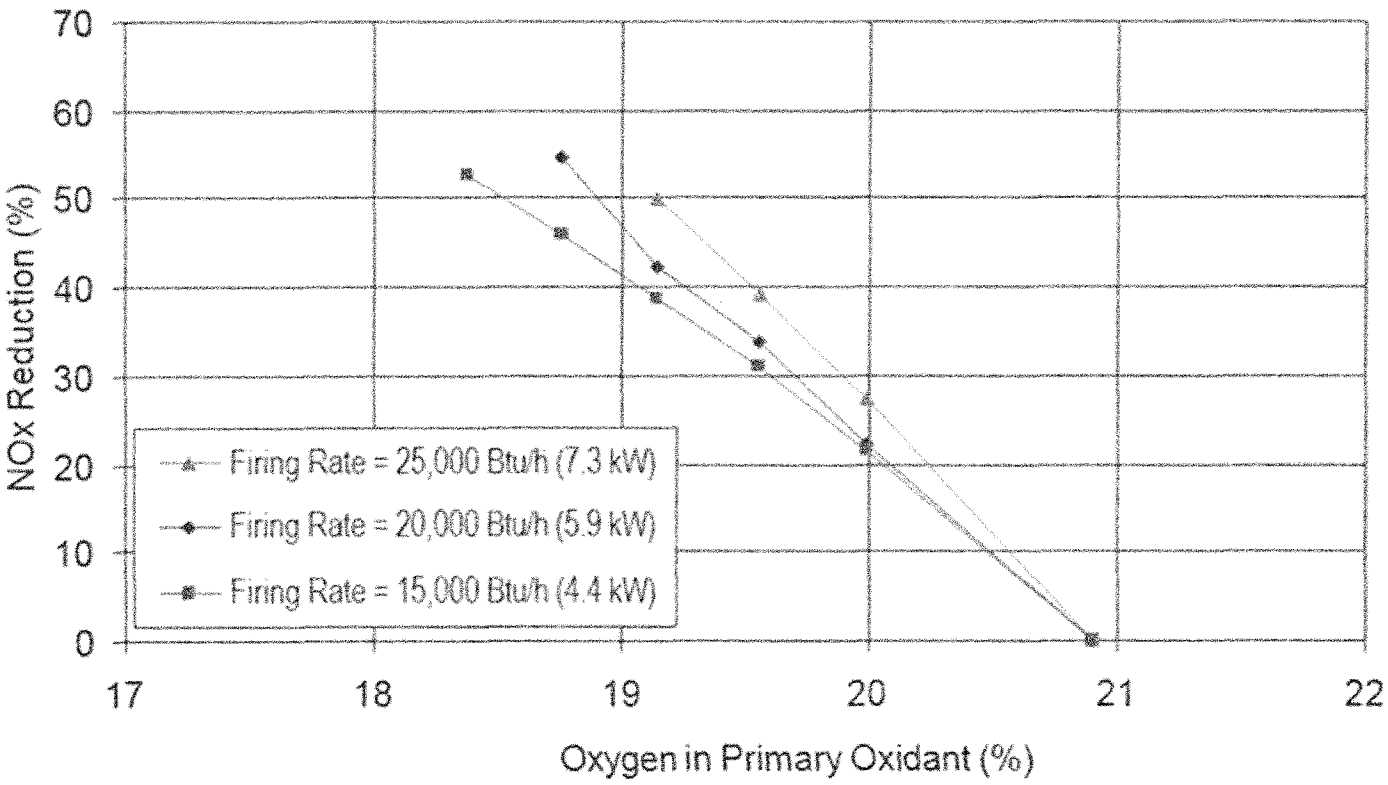
FIG. 4 is a graphical representation of NOx reduction versus oxygen content in the primary oxidant realized at selected burn rates of a ribbon burner in accordance with some examples herein described.

FIG. 4 shows the effect of the primary oxygen content on NOx reduction at a primary equivalence ratio of 1.053. The reduction of NOx is close to 50% for 25,000 BTU/h (7.3 kW) firing rate and exceeds 50% for the firing rates of 15,000 BTU/h (4.4 kW) and 20,000 BTU/h (5.9 kW).

Thus, the invention provides methods and systems such that desired performance of partially premixed ribbon type burners can be realized without jeopardizing the simplicity, cost, and reliability for which ribbon burners are well known. Thus, the invention allows industrial companies to meet new stricter regulations such as those further limiting NOx emissions without requiring expensive modification or replacement of classic or customary ribbon burners.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

We claim:

1. A method for reducing emissions of nitrogen oxides from a ribbon burner that upon combustion operation forms a flue gas including combustion products, said method comprising:

admixing a portion of the flue gas combustion products with a primary oxidizer to form a flue gas and oxidizer combination having a reduced concentration of oxygen as compared to the primary oxidizer, wherein the oxygen content of the flue gas and oxidizer combination is reduced to no more than 20 volume %;

admixing a fuel with the flue gas and oxidizer combination to form a combustible mixture;

feeding the combustible mixture to the ribbon burner to combust the combustible mixture, wherein the ribbon burner is elongated and has a long thin slot filled with corrugated metal strips to create a narrow array of short interconnected flames and wherein the reduced concentration of oxygen in the flue gas and oxidizer combination reduces emissions of nitrogen oxides from the ribbon burner; and providing a secondary oxidizer to pass to the flames of the ribbon burner for more complete combustion of the fuel.

2. The method of claim 1 wherein the ribbon burner combusts a fuel gas selected from the group consisting of natural gas, propane, butane, syngas and landfill gas.

3. The method of claim 1 wherein the ribbon burner combusts natural gas.

4. The method of claim 1 wherein the primary oxidizer comprises air.

5. The method of claim 4 wherein the oxygen content of the flue gas and air oxidizer combination is reduced to no more than 20 volume %.

6. The method of claim 4 wherein the oxygen content of the flue gas and air oxidizer combination is reduced to no more than 19 volume %.

7. The method of claim 1 wherein the flue gas combustion products and the primary oxidizer are drawn from respective sources by a single blower.

8. A method for reducing emissions of nitrogen oxides from a partially aerated ribbon burner that combusts a fuel gas of natural gas or propane, said method comprising:

admixing a portion of carbon dioxide-containing flue gas combustion product formed upon combustion of the fuel gas by the partially aerated ribbon burner with a primary oxidizer to form a flue gas and oxidizer combination having a reduced concentration of oxygen as compared to the primary oxidizer, wherein the oxygen content of the flue gas and oxidizer combination is reduced to no more than 20 volume %;

admixing the fuel gas of natural gas or propane with the flue gas and oxidizer combination to form a combustible mixture;

feeding the combustible mixture to the ribbon burner to combust the combustible mixture, wherein the partially aerated ribbon burner is elongated and has a long thin slot filled with corrugated metal strips to create a narrow array of short interconnected flames and wherein the reduced concentration of oxygen in the flue gas and oxidizer combination reduces emissions of nitrogen oxides from the partially aerated ribbon burner; and providing a secondary oxidizer to pass to the flames of the partially aerated ribbon burner for more complete combustion of the fuel gas.

9. The method of claim 8 wherein the fuel gas comprises natural gas.

10. The method of claim 8 wherein the primary oxidizer to which the carbon dioxide-containing flue gas combustion product formed upon combustion of the fuel gas is admixed comprises air.

11. The method of claim 10 wherein the oxygen content of the flue gas and oxidizer combination is reduced to no more than 19 volume %.

12. The method of claim 8 wherein the carbon dioxide-containing flue gas combustion product and the primary oxidizer are drawn from respective sources by a single blower.

13. A method for reducing emissions of nitrogen oxides from a partially aerated ribbon burner that upon combustion operation reacts a fuel gas with air oxidizer to form combustion products, the air oxidizer having an oxygen content, said method comprising:

admixing a portion of the combustion products with the air oxidizer to form a oxidant-containing combination having a reduced oxygen content as compared to the air oxidizer alone, wherein the oxygen content of the oxidant-containing combination is reduced to no more than 20 volume %;

subsequently admixing a fuel with the oxidant-containing combination to form a combustible mixture;

feeding the combustible mixture to the partially aerated ribbon burner to combust the combustible mixture, wherein the partially aerated ribbon burner is elongated and has a long thin slot filled with corrugated metal strips to create a narrow array of short interconnected flames and wherein the reduced oxygen content of the oxidant-containing combination reduces emissions of nitrogen oxides from the partially aerated ribbon burner; and providing a secondary oxidizer to pass to the flames of the partially aerated ribbon burner for more complete combustion of the fuel.

14. The method of claim 13 wherein the fuel gas is selected from the group consisting of natural gas, propane, butane, syngas and landfill gas.

15. The method of claim 13 wherein the fuel gas comprises natural gas.

16. The method of claim 13 wherein the oxygen content of the oxidant-containing combination is reduced to no more than 19 volume %.

17. The method of claim 13 wherein the combustion products and the air oxidizer are drawn from respective sources by a single blower.

18. The method of claim 1 wherein the secondary oxidizer is passed to the flames of the ribbon burner without being premixed with fuel.

19. The method of claim 1 wherein the admixing of the fuel with the flue gas and oxidizer combination to form a combustible mixture comprises all the fuel fed to the ribbon burner.

* * * * *